US008890796B2

(12) United States Patent
Lee et al.

(10) Patent No.: US 8,890,796 B2
(45) Date of Patent: Nov. 18, 2014

(54) METHOD AND CIRCUIT FOR SYNCHRONIZING INPUT AND OUTPUT SYNCHRONIZING SIGNALS, BACKLIGHT DRIVER IN LIQUID CRYSTAL DISPLAY DEVICE USING THE SAME, AND METHOD FOR DRIVING THE BACKLIGHT DRIVER

(75) Inventors: Joung-Woo Lee, Paju-si (KR); Jun-Hyeok Yang, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 142 days.

(21) Appl. No.: 13/325,927

(22) Filed: Dec. 14, 2011

(65) Prior Publication Data

US 2012/0169801 A1 Jul. 5, 2012

(30) Foreign Application Priority Data

Dec. 31, 2010 (KR) ..... 10-2010-0140615

(51) Int. Cl.
*G09G 3/36* (2006.01)
*G09G 3/34* (2006.01)

(52) U.S. Cl.
CPC ..... *G09G 3/3406* (2013.01); *G09G 2310/08* (2013.01); *G09G 2320/064* (2013.01)
USPC ..... 345/102

(58) Field of Classification Search
CPC ..... G09G 3/3406; G09G 2320/064; G09G 2310/08
USPC ..... 345/102, 99, 87
See application file for complete search history.

(56) References Cited

U.S. PATENT DOCUMENTS 6,208,188 B1 3/2001 Shionoya
6,498,536 B1 * 12/2002 Mori ..... 331/11
8,065,552 B2 * 11/2011 Sano ..... 713/500
2005/0104837 A1 5/2005 Baik et al.

(Continued)

FOREIGN PATENT DOCUMENTS

CN 101714342 A 5/2010
CN 101763781 A 6/2010

(Continued)

OTHER PUBLICATIONS

Office Action and Search Report issued in corresponding Chinese Patent Application No. 201110386600.2, mailed Jan. 17, 2014, 12 pages.

(Continued)

*Primary Examiner* — Chanh Nguyen
*Assistant Examiner* — Tsegaye Seyoum
(74) *Attorney, Agent, or Firm* — Brinks Gilson & Lione

(57) ABSTRACT

A method and a circuit for synchronizing input and output synchronizing signals are disclosed. The method for synchronizing input and output synchronizing signals includes detecting an Nth (N is a positive integer) input period of the input synchronizing signal, determining whether the detected Nth input period is the same with a prior (N−1) the output period of the output synchronizing signal, detecting a difference between an end time of the (N−1)the output period and an end time of the Nth input period, if the detected Nth input period is not the same with the (N−1)the output period, operating the detected difference with the Nth input period, and setting the operated value as an Nth output period, and generating and outputting the output synchronizing signal having the set Nth output period.

32 Claims, 6 Drawing Sheets

(56) References Cited

U.S. PATENT DOCUMENTS

| | | | | |
|---|---|---|---|---|
| 2006/0125771 | A1 | 6/2006 | Inuzuka et al. | |
| 2007/0211014 | A1* | 9/2007 | Kim et al. | 345/102 |
| 2010/0165010 | A1 | 7/2010 | Baik et al. | |

FOREIGN PATENT DOCUMENTS

| | | | |
|---|---|---|---|
| CN | 101813851 | A | 8/2010 |
| JP | 2006-091242 | | 4/2006 |
| KR | 1020100075074 | A | 7/2010 |
| TW | 358264 | | 5/1999 |
| TW | 200615892 | | 5/2006 |
| TW | I268473 | | 12/2006 |
| TW | 200917236 | | 4/2009 |

OTHER PUBLICATIONS

Office Action issued in corresponding Korean Patent Application No. 10-2010-0140615, mailed May 8, 2013.

Office Action issued in corresponding Taiwanese Patent Application No. 100140948, dated Mar. 17, 2014, 11 pages.

* cited by examiner

METHOD AND CIRCUIT FOR SYNCHRONIZING INPUT AND OUTPUT SYNCHRONIZING SIGNALS, BACKLIGHT DRIVER IN LIQUID CRYSTAL DISPLAY DEVICE USING THE SAME, AND METHOD FOR DRIVING THE BACKLIGHT DRIVER

CROSS REFERENCE TO RELATED APPLICATION

This application claims the benefit of the Patent Korean Application No. 10-2010-0140615, filed on Dec. 31, 2010, which is hereby incorporated by reference as if fully set forth herein.

BACKGROUND OF THE DISCLOSURE

1. Field of the Disclosure

The present disclosure relates to method and circuit for synchronizing input and output synchronizing signals, and more particularly to method and circuit for synchronizing input and output synchronizing signals, which can make fast synchronization of an output synchronizing signal to a change of a frequency of an input synchronizing signal, a backlight driver in a liquid crystal display device using the same, and a method for driving the backlight driver.

2. Discussion of the Related Art

In a flat display device for displaying an image by using a digital data, a liquid crystal display (LCD) device which uses liquid crystals, a plasma display panel PDP which uses discharge of inert gas, and an organic light emitting diode OLED which uses an organic light emitting diode are typical. Of the flat display devices, the liquid crystal display device has many fields of applications, such as TV sets, notebook computers, and cellular phones.

The liquid crystal display device displays a picture with a pixel matrix by utilizing electric and optical characteristics of the liquid crystals, which have anisotropy of refractive index and dielectric. Each pixel in the liquid crystal display device controls light transmissivity of a light transmitting through a polarizing plate by varying an orientation of the liquid crystals in response to a data signal, to produce a gradient. The liquid crystal display device is provided with a liquid crystal panel, which displays the picture with the pixel matrix, a driving circuit for driving the liquid crystal panel, a backlight unit for emitting a light to the liquid crystal panel, and a backlight driver for driving the backlight unit.

Recently, as the backlight unit, an LED backlight is being used, having a light emitting diode (Hereafter, LED) applied thereto, to have advantages of a fast tuning on speed, high brightness, and low power consumption compared to a related art lamps. The LED backlight emits a white light by using a white LED, or a combination of red/green/blue LEDs. And, the LED backlight has, not only an advantage of global dimming in which brightness of the backlight is controlled on the whole, but also an advantage of local dimming in which the brightness of the backlight is controlled location by location, i.e., block by block.

The backlight driver, which drives the LED backlight, generates a pulse width modulation PWM signal having a duty ratio matched to a dimming value received from an external system such as a TV set, or a timing controller. The backlight driver controls turn-on/turn-off time of the LED backlight according to the PWM signal for adjusting the brightness of the LED backlight.

In order to drive the LED backlight in synchronization with the liquid crystal panel, the backlight driver receives a vertical synchronizing signal from an external system for dividing frames of a video data. In order to deal with variation of a frequency of the vertical synchronizing signal received thus, the backlight driver calculates an input period of the vertical synchronizing signal at every frame for setting an output period, and generates an inner clock required for producing the duty of the PWM signal by using the output period of the vertical synchronizing signal.

However, in a case the input/output periods of the vertical synchronizing signals are calculated at every frame, if the frequency of the vertical synchronizing signal changes suddenly, the related art backlight driver fails to set the output period matched to the input period changed suddenly thus, consequently failing generation of the inner clock. According to this, the inner clock generation error causes the duty ratio to be outside of a desired range, resulting in a change of brightness of the LED backlight, causing a poor picture quality, such as flicker on a screen.

SUMMARY OF THE DISCLOSURE

A method for synchronizing input and output synchronizing signals, includes detecting an Nth (N is a positive integer) input period of the input synchronizing signal, determining whether the Nth input period detected thus is the same with a prior (N−1)th output period of the output synchronizing signal or not, detecting a difference between an end time point of the (N−1)th output period and an end time point of the Nth input period, if the Nth input period detected in above step is not the same with the (N−1)th output period, subjecting the difference detected in above step to operation with the Nth input period, and setting a value obtained by the operation as an Nth output period, and generating and outputting the output synchronizing signal having the Nth output period set in above step.

In another aspect of the present invention, a method for driving a backlight driver includes synchronizing an output vertical synchronizing signal to a change of an input period of an input vertical synchronizing signal by using the method for synchronizing input and output synchronizing signals as described above, generating an inner clock with reference to the output period set thus, and generating a pulse width modulation signal having a desired duty ratio by using the inner clock, to drive a backlight unit.

In another aspect of the present invention, a circuit for synchronizing input and output synchronizing signals includes a synchronizing signal input unit that detects an Nth (N is a positive integer) input period of the input synchronizing signal, a microcontroller unit that determines whether the Nth input period from the synchronizing signal input unit is the same with a prior (N−1)th output period of the output synchronizing signal or not, detects a difference between an end time point of the (N−1)th output period and an end time point of the Nth input period, if the Nth input period detected in above step is not the same with the (N−1)th output period, subjects the difference to operation with the Nth input period, and sets a value obtained by the operation as an Nth output period, and a synchronizing signal output unit that generates and outputs a synchronizing signal having the Nth output period set by the microcontroller unit.

In another aspect of the present invention, a backlight driver in a liquid crystal display device, includes the circuit that synchronizes input and output synchronizing signals, as described above, that synchronizes an output vertical synchronizing signal to a change of an input period of an input vertical synchronizing signal, a clock generator that generates an inner clock with reference to the output period set by the circuit, and a pulse width modulation signal generator that generates a pulse width modulation signal having a desired duty ratio by using the inner clock, to drive the backlight unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
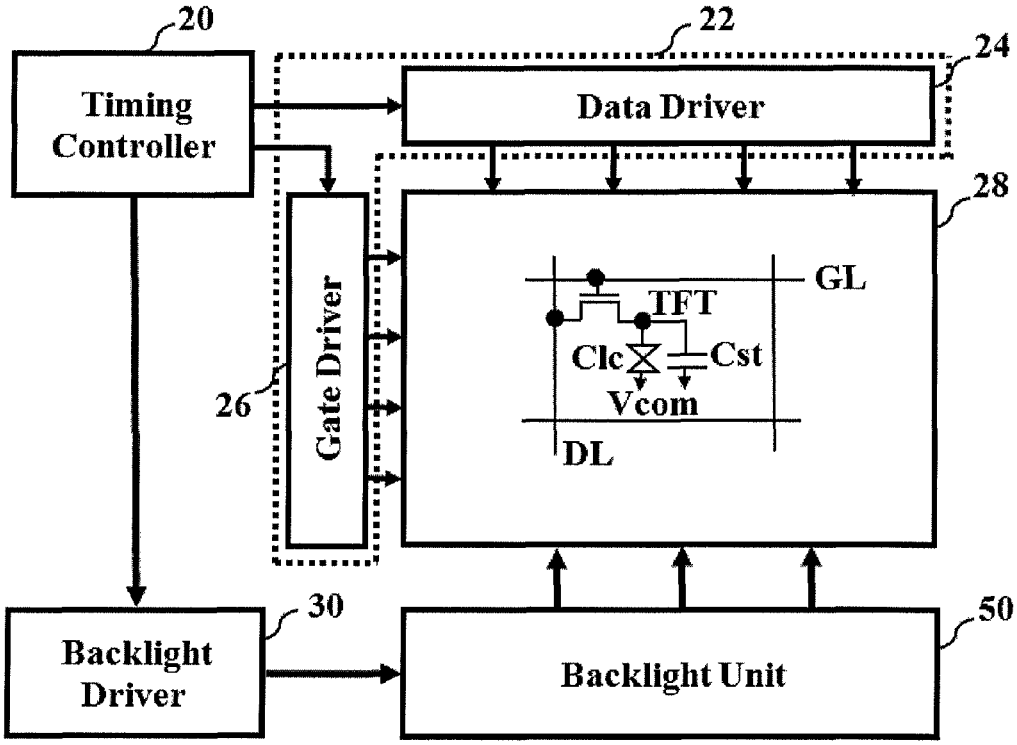
FIG. 1 illustrates a block diagram of a liquid crystal display device in accordance with a preferred embodiment of the present invention, schematically.

FIG. 1 illustrates a block diagram of a liquid crystal display device in accordance with a preferred embodiment of the present invention, schematically.

Referring to FIG. 1, the liquid crystal display device includes a liquid crystal panel 28, a backlight unit 50, a panel driver 22 having a data driver 24 and a gate driver 26 for driving the liquid crystal panel 28, a backlight driver 30 for driving the backlight unit 50, and a timing controller 20 for controlling driving of the panel driving unit 22 and the backlight driver 30.

The timing controller 20 corrects data received from an outside by using various data processing methods for improvement of a picture quality or reduction of power consumption, and outputs the data to the data driver 24 in the panel driving unit 22. For an example, in a case the LED backlight unit 50 is driven by local dimming, the timing controller 20 analyzes the data received thus and determines a local dimming value for controlling brightness of the backlight unit block by block, as well as compensates the data for the brightness reduced by the local dimming thus. In order to improve a response speed of the liquid crystals, the timing controller 20 also corrects the data received thus into an overdriving data by applying an overshoot value or an undershoot value selected from a look-up table to the data depending on a data difference between adjacent frames, and outputs the data corrected thus. And, the timing controller generates a data control signal which controls driving timing of the data driver 24 and a gate control signal which controls driving timing of the gate driver 26 by using a plurality of synchronizing signals from an outside, i.e., a vertical synchronizing signal, a horizontal synchronizing signal, a data enable signal, and a dot clock. The timing controller 20 outputs the data control signal and the gate control signal generated thus to the data driver 24 and the gate driver 26, respectively. The data control signal includes a source start pulse and source sampling clock which control latching of the data signal, a polarity control signal for controlling a polarity of the data signal, and a source output enable signal which controls an output period of the data signal. The gate control signal includes a gate start pulse and a gate shift clock which control scanning of the gate signal, a gate output enable signal which controls an output period of the gate signal.

The panel driving unit 22 includes the data driver 24 for driving the data line DL in the liquid crystal panel 28, and the gate driver 26 for driving the gate line GL in the liquid crystal panel 28.

The data driver 24 supplies the video data from the timing controller 20 to a plurality of data lines DL in the liquid crystal panel 28 in response to the data control signal from the timing controller 20. The data driver 24 receives the digital data from the timing controller 20, converts the digital data into a positive/negative analog data signal by using a gamma voltage, and supplies the analog data signal to the data line DL every time a relevant gate line GL is driven. The data driver 24 has at least one data IC mounted to a circuit film, such as TCP, COF, and FPC, attached to the liquid crystal panel by TAB (Tape Automatic Bonding) or mounted to the liquid crystal panel 28 by COG (Chip On Glass).

The gate driver 26 successively drives a plurality of gate lines GL formed at the thin film transistor array of the liquid crystal panel 28 in response to the gate control signal from the timing controller 20. The gate driver 26 supplies the scan pulse of the gate on voltage at relevant scan period of each gate lines GL, and a gate off voltage in the other periods in which other gate line GL is driven. The gate driver 26 has at least one gate IC mounted to a circuit film, such as TCP (Tape Carrier Package), COF (Chip On Film), and FPC (Flexible Print Circuit), attached to the liquid crystal panel by TAB (Tape Automatic Bonding) or mounted to the liquid crystal panel 28 by COG (Chip On Glass). And, the gate driver 26 may be formed on the thin film transistor substrate together with the pixel array built in the liquid crystal panel 28 by GIP (Gate In Panel).

The liquid crystal panel 28 includes a color filter substrate having a color filter array formed thereon, a thin film transistor array substrate having a thin film transistor array formed thereon, a liquid crystal layer between the color filter substrate and the thin film transistor substrate, and a polarizing plate attached to an outside of each of the color filter substrate and the thin film transistor substrate. The liquid crystal panel 28 displays an image by means of a pixel matrix having a plurality of pixels arranged thereon. Each of the pixels produces a desired color by a combination of red, green, and blue sub-pixels each of which varies an orientation of the liquid crystals according to the data signal to adjust light transmissivity. Each of the sub-pixels has a thin film transistor TFT connected to a gate line GL and a data line DL, a liquid crystal capacitor Clc and a storage capacitor Cst connected to the thin film transistor TFT in parallel. The liquid crystal capacitor Clc charges a difference between the data signal supplied to the pixel electrode through the thin film transistor TFT and a common voltage Vcom supplied to the common electrode therein, and drives the liquid crystals according to the voltage charged thus to adjust light transmissivity. The storage capacitor Cst sustains the voltage charged in the liquid crystal capacitor Clc. The liquid crystal layer is driven by a vertical electric fieldat a TN (Twisted Nematic) mode or a VA (Vertical Alignment) mode, or by a horizontal electric fieldat an IPS (In-Plane Switching) or an FFS (Fringe Field Switching) mode.

The backlight unit 50 is a direct lighting type or an edge lighting type, and driven by the backlight driver 30 divided into a plurality of blocks for directing a light to the liquid crystal panel 28. The direct lighting type backlight unit has an LED array arranged throughout a display region opposite to the liquid crystal panel 28. The edge lighting type backlight unit has an LED array arranged to face at least two edges of a light guide plate arranged opposite to the liquid crystal panel 28 so that the light from the LED array is converted into a surface light source and directed to the liquid crystal panel 28.

The backlight driver 30 drives the LED backlight unit 50 block by block to control the brightness block by block according to the dimming value from the external system or the timing controller 20. If the backlight unit 50 is driven divided into a plurality of port regions, the backlight unit 50 may be provided with a plurality of backlight drivers 30 for driving the plurality of port regions, independently. The backlight driver 30 generates the PWM signal having a duty ratio matched to the dimming value block by block, and supplies an LED driving signal matched to the PWM signal generated thus LED block by LED block, for driving the backlight unit 50. In this instance, in order synchronize the backlight unit 50 to the liquid crystal panel 28, the backlight driver 30 generates the PWM signal by using the vertical synchronizing signal which is a frame sorting signal received from the external system or the timing controller 20.

Particularly, in order to deal with the frequency variation of an input vertical synchronizing signal, the backlight driver 30 counts an input period of the vertical synchronizing signal at every frame (every period) to detect the input period, sets an output period by using the input period, and generates and outputs a vertical synchronizing signal having the output period. The backlight driver 30 generates the inner clock required for generation of the duty of the PWM signal with reference to the output period of the vertical synchronizing signal.

In detail, in order to synchronize the input/output vertical synchronizing signals, the backlight driver 30 detects the input period of the input vertical synchronizing signal at every frame (every period), and compares the input period to a prior output period of the output vertical synchronizing signal. If the input period of the vertical synchronizing signal is the same with the prior output period, the backlight driver 30 generates and outputs a vertical synchronizing signal having an output period the same with the input period (I.E., the prior output period). Opposite to this, if the input period of the vertical synchronizing signal is not the same with the prior output period, the backlight driver 30 detects a difference between an end time point of the input period and an end time point (A prior output period) of the prior output period, and adjusts the input period as much as the difference. And, the backlight driver 30 sets the input period adjusted thus as the output period, and generates and outputs the vertical synchronizing signal having the output period set thus. Details of this will be described, later.

Eventually, even if the input period varies suddenly, since the backlight driver 30 may synchronize the input and output vertical synchronizing signals within a few frames by using the output period obtained by adjusting the input period detected according to the variation of the input period of the vertical synchronizing signal, and predicts the output period in advance before generation of the output vertical synchronizing signal, the backlight driver 30 may generate a predetermined inner clock by using a stable output period at every frame even in steps of synchronizing the input and output vertical synchronizing signals. As a result of this, the backlight driver 30 may prevent omission of the inner clock caused by the variation of the frequency of the input vertical synchronizing signal and make stable generation of the PWM signal having a desired duty ratio.

In the meantime, in order to secure a time period of operation for comparing the input period of the vertical synchronizing signal to the prior output period, adjusting the input period according to a result of the comparison, and using the input period adjusted thus as the output period, the backlight driver 30 generates and outputs the output vertical synchronizing signal such that the output vertical synchronizing signal has a delay time period of in a range of at least one frame (One period) from the input vertical synchronizing signal.

And, before synchronizing the output and input vertical synchronizing signals, i.e., before comparing the input period of the input vertical synchronizing signal to the prior output period of the output vertical synchronizing signal, the backlight driver 30 may perform a step of comparing the input period detected thus to a reference range having a preset minimum value MIN and a preset maximum value MAX additionally, and perform synchronization of the input and output vertical synchronizing signals, selectively.

For an example, if the input period of the vertical synchronizing signal detected thus is within the reference range, the backlight driver 30 compares the input period of the input vertical synchronizing signal to the prior period of the output vertical synchronizing signal, and progresses a step for synchronizing the input and output vertical synchronizing signals according to a result of the comparison. Opposite to this, if the input period of the vertical synchronizing signal detected thus is outside of the reference range, the backlight driver 30 generates and outputs an output vertical synchronizing signal which maintains the prior output period without the step for synchronizing the input and output vertical synchronizing signals. The reference range of the vertical synchronizing signal is set and stored in an inner register of the backlight driver 30 by a designer.

Eventually, the backlight driver 30 may make stable generation and outputting of the output vertical synchronizing signal even in a case the input vertical synchronizing signal is outside of the reference range due to external noise and the like.

Figure 2:
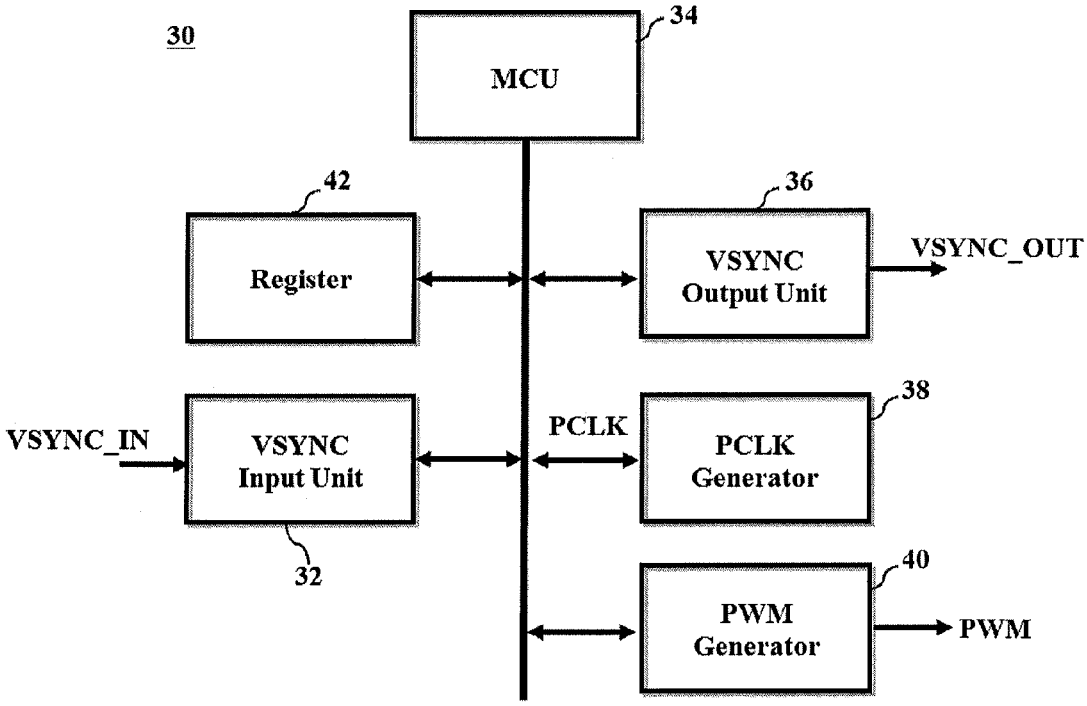
FIG. 2 illustrates a block diagram of the backlight driver in FIG. 1.

FIG. 2 illustrates a block diagram of the backlight driver in FIG. 1.

Referring to FIG. 2, the backlight driver 30 includes a vertical synchronizing signal VSYNC input unit 32, a microcontroller unit MCU 34, a vertical synchronizing signal VSYNC output unit 36, an inner clock PCLK generator 38, a PWM signal generator 40, and a register 42.

The VSYNC input unit 32 detects the input period of the input vertical synchronizing signal VSYNC_IN from the external system or the timing controller 20, and outputs the input period to the MCU 34.

The MCU 34 stores the input period detected thus at the VSYNC input unit 32 to the register 42, and determines whether the input period is within the period reference range MIN-MAX stored in the register 42 or not. If the input period is outside of the reference range MIN-MAX, the MCU 34 maintains the prior output period of the output vertical synchronizing signal stored in the register 42. If the input period is within the reference range MIN-MAX, the MCU 34 determines whether the input period is the same with the prior output period or not. If the input period of the vertical synchronizing signal is the same with the prior output period, the MCU 34 sets the input period as the output period and stores the same in the register 42. Opposite to this, if the input period of the vertical synchronizing signal is not the same with the prior output period, the MCU 34 detects a difference between the end time point of the input period and the end time point (A time point when the prior output period ends) of the prior output period, and sets a value obtained by subjecting the difference detected thus to operation with the input period (addition or subtraction) as the output period, and stores the output period in the register 42.

The VSYNC output unit 36 generates and outputs the output vertical synchronizing signal VSYNC_OUT having the output period stored in the register 42. The output vertical synchronizing signal VSYNC_OUT is output to a next stage backlight driver if a plurality of backlight drivers are connected in a cascade.

The PCLK generator 38 generates and outputs the inner clock PCLK with reference to the output period stored in the register 42.

The PWM signal generator 40 generates the PWM signal having a duty ratio according to a dimming value from the external system or the timing controller 20 by using the inner clock PCLK from the PCLK generator 38, and outputs the PWM signal to the backlight unit 50.

Figure 3:
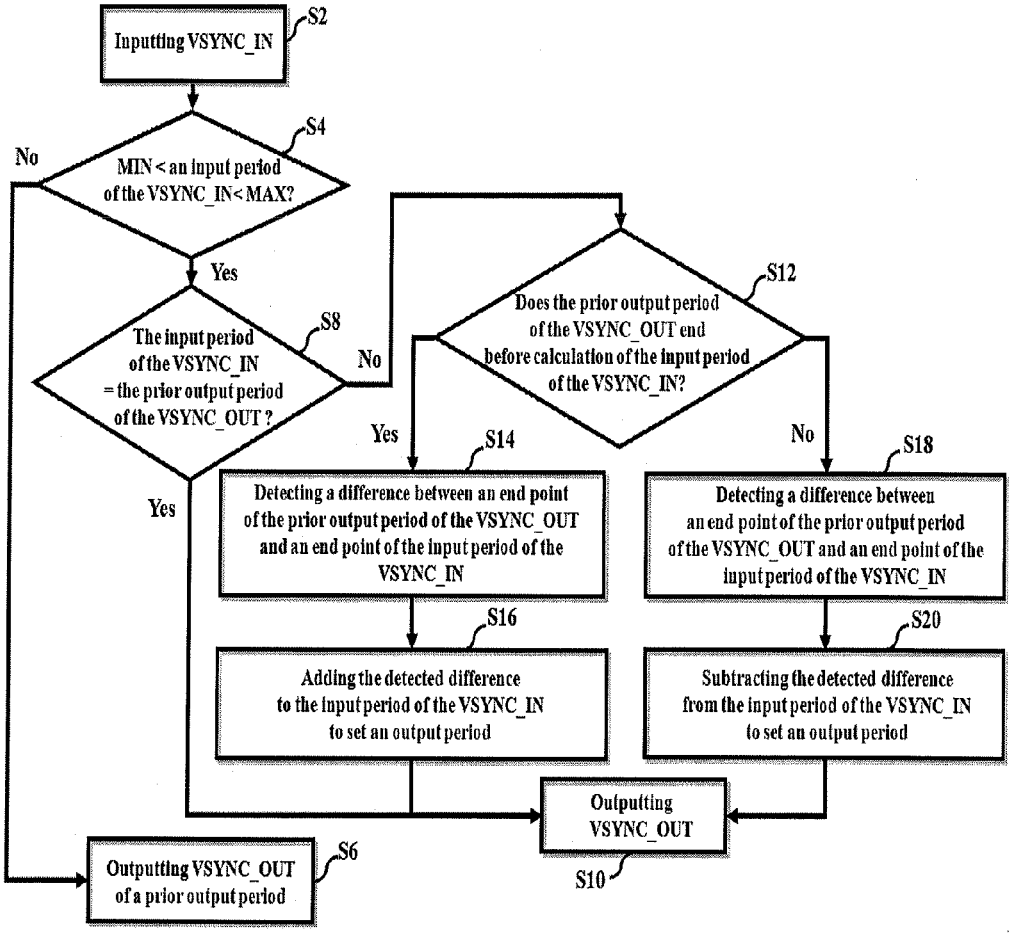
FIG. 3 illustrates a flow chart showing the steps of a method for synchronizing input and output vertical synchronizing signals of a backlight driver in accordance with a preferred embodiment of the present invention.

FIG. 3 illustrates a flow chart showing the steps of a method for synchronizing input and output vertical synchronizing signals of a backlight driver in accordance with a preferred embodiment of the present invention.

In a step S2, the backlight driver 30 detects the present Nth (N is a positive integer) period from the vertical synchronizing signal VSYNC_IN received from an outside thereof. The input period of the vertical synchronizing signal VSYNC_IN is detected by counting the input vertical synchronizing signal VSYNC_IN with a system clock SCLK generated in the backlight driver 30. The backlight driver 30 stores the Nth input period detected thus in the inner register 42. The backlight driver 30 detects the input period in every period to update the input period in the inner register 42.

In a step S4, the backlight driver 30 compares the Nth input period of the vertical synchronizing signal VSYNC_IN detected in the step S2 to a preset period reference range MIN-MAX, to determine whether the Nth input period is within the period reference range MIN-MAX or not. The reference range MIN-MAX on the input vertical synchronizing signal VSYNC_IN is preset and stored in the register 42 by the designer for preventing noise and the like from taking place.

If the Nth input period of the input vertical synchronizing signal VSYNC_IN is outside of the period reference range MIN-MAX (NO) in the step S4, the backlight driver 30 performs a next step S6. In the step S6, the backlight driver 30 generates and outputs an Nth output vertical synchronizing signal VSYNC_OUT having an output period the same with a prior (N−1)th output period stored in the register 42. In other words, if the backlight driver 30 determines that the input period of the Nth input vertical synchronizing signal VSYNC_IN is shorter than a minimum value MIN of the reference range MIN-MAX, or longer than a maximum value MAX of the reference range MIN-MAX, the backlight driver 30 sets the prior (N−1)th output period as the Nth output period to make stable generation and outputting of the Nth output vertical synchronizing signal VSYNC_OUT. Eventually, the backlight driver 30 may make stable generation and outputting of the output vertical synchronizing signal VSYNC_OUT even in a case the input vertical synchronizing signal VSYNC_IN is unstable due to external noise and the like. The backlight driver 30 stores the Nth output period of the output vertical synchronizing signal VSYNC_OUT generated thus in the register 42 for using the Nth output period as the prior period value in a next period.

Opposite to this, if the Nth input period of the input vertical synchronizing signal VSYNC_IN is within the period reference range MIN-MAX (YES) in the step S4, the backlight driver 30 performs a next step S8. In the step S8, the backlight driver 30 compares the Nth input period of the input vertical synchronizing signal VSYNC_IN stored in the register 42 to the prior (N−1)th output period of the output vertical synchronizing signal VSYNC_OUT, to determine whether the Nth input period is the same with the (N−1)th output period or not.

If the Nth input period of the input vertical synchronizing signal VSYNC_IN is the same with the prior (N−1)th output period of the output vertical synchronizing signal VSYNC_OUT (YES) in the step S8, the backlight driver 30 performs a next step S10. In the step S10, the backlight driver 30 sets the Nth input period as the Nth output period and stores the Nth output period in the register 42, and generates and outputs the Nth output vertical synchronizing signal VSYNC_OUT having the output period stored thus.

Opposite to this, if the Nth input period of the input vertical synchronizing signal VSYNC_IN is not the same with the prior (N−1)th output period of the output vertical synchronizing signal VSYNC_OUT (NO) in the step S8, the backlight driver 30 performs a next step S12. In the step S12, the backlight driver 30 determines whether the (N−1)th output period of the output vertical synchronizing signal VSYNC_OUT ends before the Nth input period of the input vertical synchronizing signal VSYNC_IN is calculated (ends) or not. That is, the backlight driver 30 determines whether the Nth input period of the input vertical synchronizing signal VSYNC_IN is longer than the (N−1)th output period or not, i.e., whether a frequency of the input vertical synchronizing signal VSYNC_IN is increased or not.

If the (N−1)th output period of the output vertical synchronizing signal VSYNC_OUT ends before the Nth input period of the input vertical synchronizing signal VSYNC_IN is calculated (ends) (YES) in the step 512, i.e., if the Nth input period becomes longer than the (N−1)th output period (a case the frequency of the input vertical synchronizing signal VSYNC_IN is increased), the backlight driver 30 performs a step S14. In the step S14, the backlight driver 30 detects a difference between the end time point of the (N−1)th output period of the output vertical synchronizing signal VSYNC_OUT and the end time point of the Nth input period of the input vertical synchronizing signal VSYNC_IN. In this instance, the end time point of the (N−1)th output period of the output vertical synchronizing signal VSYNC_OUT may be predicted from the (N−1)th output period stored in the register 42.

Then, in a next step S16, the backlight driver 30 adds the difference between the end time point of the (N−1)th output period of the output vertical synchronizing signal VSYNC_OUT and the end time point of the Nth input period of the input vertical synchronizing signal VSYNC_IN detected in the step S14 to the Nth input period to set an added value thus as the Nth output period. Then, the backlight driver 30 proceeds to the step S10 to generate and forward the output vertical synchronizing signal VSYNC_OUT having the Nth output period set in the step 16 S16 thus.

In the meantime, if the (N−1)th output period of the output vertical synchronizing signal VSYNC_OUT does not end before the Nth input period of the input vertical synchronizing signal VSYNC_IN is calculated (ends) (NO) in the step S12, i.e., if the Nth input period becomes shorter than the (N−1)th output period (A case the frequency of the input vertical synchronizing signal VSYNC_IN is decreased), the backlight driver 30 performs a step S18. In the step S18, the backlight driver 30 detects the difference between the end time point of the (N−1)th output period of the output vertical synchronizing signal VSYNC_OUT and the end time point of the Nth input period of the input vertical synchronizing signal VSYNC_IN.

In a next step S20, the backlight driver 30 subtracts the difference between the end time point of the (N−1)th output period of the output vertical synchronizing signal VSYNC_OUT and the end time point of the Nth input period of the input vertical synchronizing signal VSYNC_IN from the Nth input period to set a subtracted value as the Nth output period. And, the backlight driver 30 proceeds to the step S10, to generate and forward the output vertical synchronizing signal VSYNC_OUT having the Nth output period set in the step S20.

Figure 4:
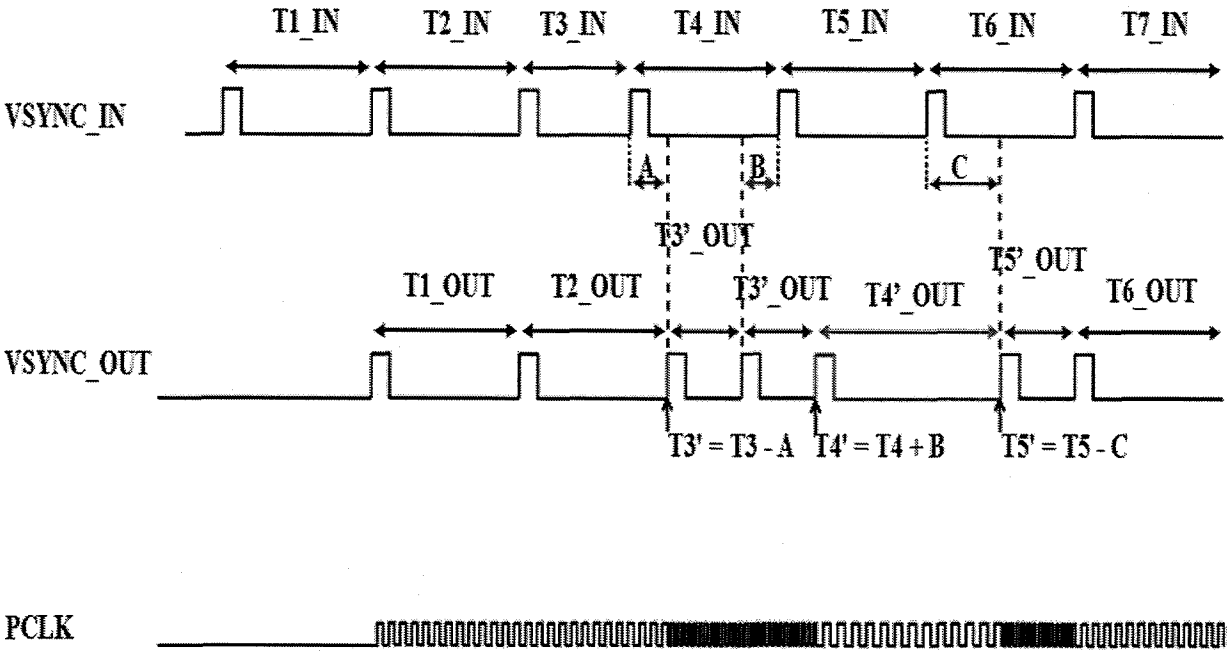
FIG. 4 illustrates driving waveforms showing synchronizing steps according to the method for synchronizing input and output vertical synchronizing signals in FIG. 3.
Figure 5:
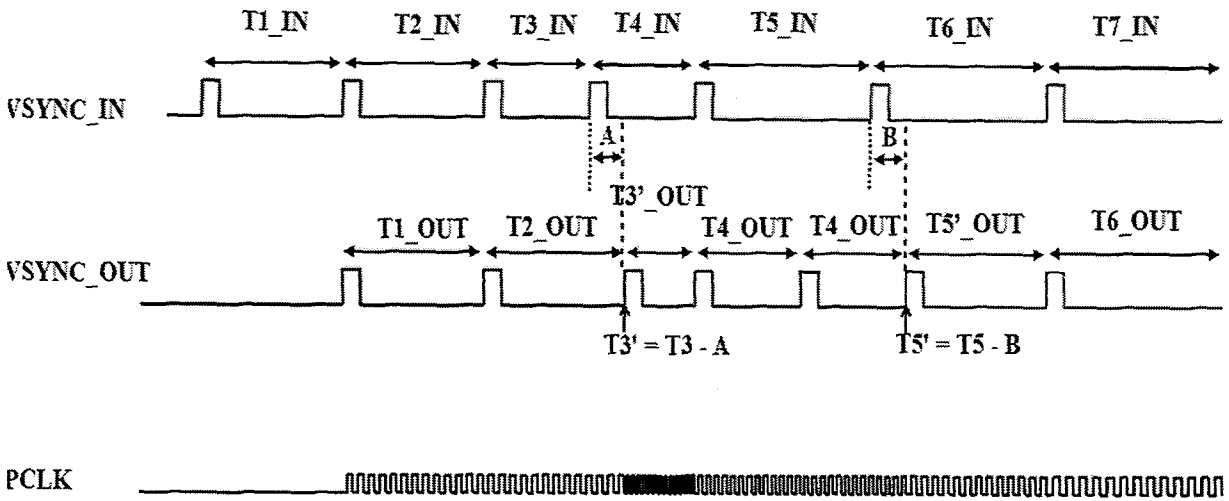
FIG. 5 illustrates driving waveforms showing other synchronizing steps according to the method for synchronizing input and output vertical synchronizing signals in FIG. 3.
Figure 6:
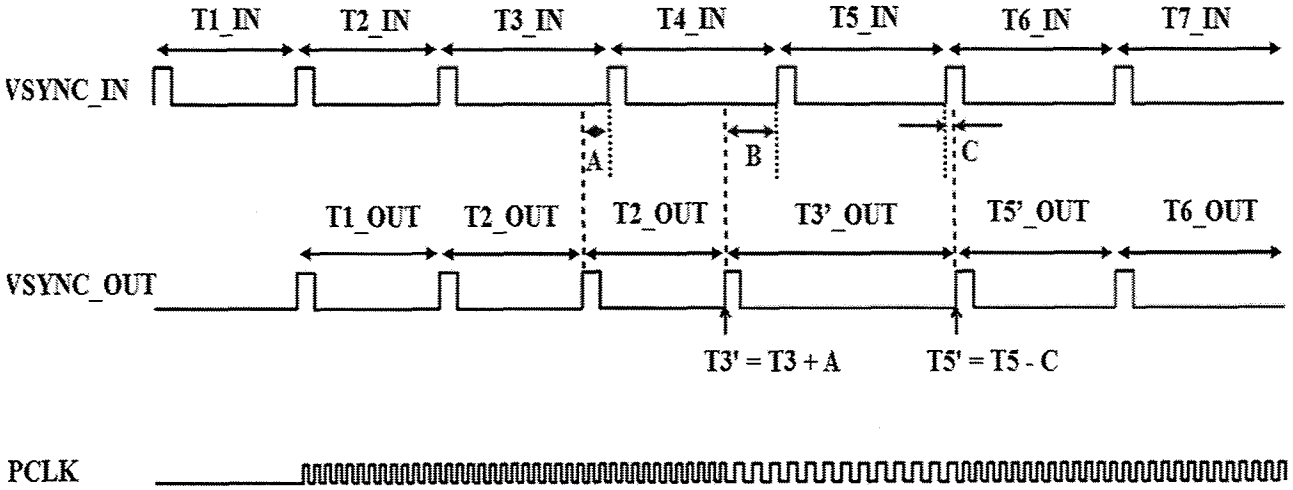
FIG. 6 illustrates driving waveforms showing other synchronizing steps according to the method for synchronizing input and output vertical synchronizing signals in FIG. 3.

FIGS. 4 to 6 illustrate driving waveforms for showing synchronizing steps from the step S8 to step S20 illustrated in FIG. 3 of the method for synchronizing input and output vertical synchronizing signals while varying the frequency of the input vertical synchronizing signal.

Referring to FIGS. 4 to 6, it may be known that, in order to secure operation time period required for progressing the step S8 to step S20 illustrated in FIG. 3, the backlight driver 30 generates and outputs the Nth output vertical synchronizing signal VSYNC_OUT such that the Nth output vertical synchronizing signal VSYNC_OUT has in a range of at least one frame (one period) of delay time period from the Nth input vertical synchronizing signal VSYNC_IN.

FIG. 4 illustrates steps of synchronizing the input and output synchronizing signals VSYNC_IN and VSYNC_OUT, if the frequency of the input vertical synchronizing signal VSYNC_IN increases only for one period, i.e., the input period increases only for one period.

Referring to FIG. 4, since a second input period T2_IN of the input vertical synchronizing signal VSYNC_IN is the same with a prior first output period T1_OUT of the output vertical synchronizing signal VSYNC_OUT (S8: Yes), the output vertical synchronizing signal VSYNC_OUT having a second output period T2_OUT the same with the second input period T2_IN is output (S10).

If the second output period T2_OUT does not end (S12: No) before the third input period T3_IN is calculated (Ends) while the third output period T3_IN is not the same with a prior second output period T2_OUT of the output vertical synchronizing signal VSYNC_OUT (S8: No) due to the reduced period (Increase frequency) of the input vertical synchronizing signal VSYNC_IN, the backlight driver 30 detects a difference A between the end time point of the second output period T2_OUT and the end time point of a third input period T3_IN (S18). And, the backlight driver 30 subtracts the difference A detected thus from the third input period T3-IN, to set a third output period T3'_OUT (S20), and generates and outputs the output vertical synchronizing signal VSYNC_OUT having the third output period T3'_OUT set thus.

In the meantime, since it is a time point before a fourth input period T4_IN of the input vertical synchronizing signal VSYNC_IN is calculated, though the third output period T3'_OUT of the output vertical synchronizing signal VSYNC_OUT ends, the backlight driver 30 outputs the third output period T3_OUT of the output vertical synchronizing signal VSYNC_OUT, repeatedly.

If the third output period T3'_OUT ends before a fourth input period T4_IN is calculated (Ends) (S12: YES) while the fourth input period (T4_IN) of the input vertical synchronizing signal VSYNC_IN is not the same with the prior third output period T3'_OUT of the output vertical synchronizing signal VSYNC_OUT (S8: NO), the backlight driver 30 detects a difference B between the end time point of the third output period T3'_OUT and the end time point of the fourth input period (T4_IN) (S14). Then, the backlight driver 30 adds the difference of detection B to the fourth input period (T4_IN), to set a fourth output period T4'_OUT (S16), and generates and outputs the output vertical synchronizing signal VSYNC_OUT having the fourth output period T4'_OUT set thus (S10).

If the fourth output period T4'_OUT does not end (S12: NO) before a fifth input period T5_IN is calculated (Ends) while the fifth input period (T5_IN) of the input vertical synchronizing signal VSYNC_IN is not the same with the prior fourth output period T4'_OUT of the output vertical synchronizing signal VSYNC_OUT (S8: NO), the backlight driver 30 detects a difference C between the end time point of the fourth output period T4'_OUT and the end time point of the fifth input period (T5_IN) (S18). Then, the backlight driver 30 subtracts the difference C detected thus from the fifth input period (T5_IN), to set a fifth output period T5'_OUT (S20), and generates and outputs the output vertical synchronizing signal VSYNC_OUT having the fifth output period T5'_OUT set thus (S10).

If the fifth output period T5'_OUT does not end (S12: NO) before a sixth input period T6_IN is calculated (Ends) while the sixth input period (T6_IN) of the input vertical synchronizing signal VSYNC_IN is not the same with the prior fifth output period T5'_OUT of the output vertical synchronizing signal VSYNC_OUT (S8: NO), the backlight driver 30 detects a difference 0 between the end time point of the fifth output period T5'_OUT and the end time point of the sixth input period (T6_IN) (S18), and adds the difference 0 detected thus to the sixth input period (T6_IN), to set a sixth output period T6'_OUT (S16). In this instance, since there is no difference between the end time point of the fifth output period T5'_OUT and the end time point of the sixth input period (T6_IN), the backlight driver 30 sets a sixth output period T6_OUT the same with the sixth input period (T6_IN) (S16), and generates and outputs the output vertical synchronizing signal VSYNC_OUT having the sixth output period T6'_OUT set thus (S10).

Then, as a seventh input period T7_IN of the input vertical synchronizing signal VSYNC_IN is the same with the sixth output period T6_OUT of the output vertical synchronizing signal VSYNC_OUT (S8: YES), the backlight driver 30 outputs the output vertical synchronizing signal VSYNC_OUT of a seventh output period T7_OUT (Not shown) which is the same with the seventh input period T7_IN.

FIG. 5 illustrates a case of steps for synchronizing input and output vertical synchronizing signals VSYNC_IN and VSYNC_OUT, if the frequency of the input vertical synchronizing signal VSYNC_IN decreases after increase for two periods, i.e., the input period increases after the input period decreases only for two periods.

Referring to FIG. 5, since a second input period T2_IN of the input vertical synchronizing signal VSYNC_IN is the same with a prior first output period T1_OUT of the output vertical synchronizing signal VSYNC_OUT (S8: Yes), the output vertical synchronizing signal VSYNC_OUT having a second output period T2_OUT the same with the second input period T2_IN is output (S10).

If the second output period T2_OUT does not end (S12: NO) before the third input period T3_IN is calculated (Ends) while the third input period T3_IN of the input vertical synchronizing signal VSYNC_IN is not the same with a prior second output period T2_OUT of the output vertical synchronizing signal VSYNC_OUT (S8: NO) due to a reduced period (Increased frequency) of the input vertical synchronizing signal VSYNC_IN, the backlight driver 30 detects a difference A between the end time point the second output period T2_OUT to end and the end time point of a third input period T3_IN (S18). And, the backlight driver 30 subtracts the difference A detected thus from the third input period T3-IN, to set a third output period T3'_OUT (S20), and generates and outputs the output vertical synchronizing signal VSYNC_OUT having the third output period T3'_OUT set thus.

If the third output period T3_OUT does not end (S12: NO) before the fourth input period T4_IN is calculated (Ends) while the fourth input period T4_IN of the input vertical synchronizing signal VSYNC_IN is not the same with a prior third output period T3'_OUT of the output vertical synchronizing signal VSYNC_OUT (S8: NO), the backlight driver 30 detects a difference 0 between the end time point of the third output period T3_OUT and the end time point of a fourth input period T4_IN (S18) and adds the difference 0 detected thus to the fourth input period T4-IN, to set a fourth output period T4_OUT (S16). In this instance, since there is no difference between the end time point of the third output period T3'_OUT and the end time point of the fourth input period (T4_IN), the backlight driver 30 sets a fourth output period T4_OUT the same with the fourth input period (T4_IN) (S16), and generates and outputs the output vertical synchronizing signal VSYNC_OUT having the fourth output period T4_OUT set thus (S10).

In the meantime, since it is a time point before a fifth input period T5_IN of the input vertical synchronizing signal VSYNC_IN is calculated, though the fourth output period T4_OUT of the output vertical synchronizing signal VSYNC_OUT ends, the backlight driver 30 outputs the fourth output period T4_OUT of the output vertical synchronizing signal VSYNC_OUT, repeatedly.

If the fourth output period T4_OUT ends before a fifth input period T5_IN is calculated (Ends) (S12: NO) while the fifth input period (T5_IN) of the input vertical synchronizing signal VSYNC_IN is not the same with the prior fourth output period T4_OUT of the output vertical synchronizing signal VSYNC_OUT (S8: NO), the backlight driver 30 detects a difference B between the end time point of the fourth output period T4_OUT and the end time point of the fifth input period (T5_IN) (S18). Then, the backlight driver subtracts the difference of detection B from the fifth input period (T5_IN), to set a fifth output period T5'_OUT (S20), and generates and outputs the output vertical synchronizing signal VSYNC_OUT having the fifth output period T5'_OUT set thus (S10).

If the fifth output period T5'_OUT does not end (S12: NO) before a sixth input period T6_IN is calculated (Ends) while the sixth input period (T6_IN) of the input vertical synchronizing signal VSYNC_IN is not the same with the prior fifth output period T5'_OUT of the output vertical synchronizing signal VSYNC_OUT (S8: NO), the backlight driver 30 detects a difference 0 between the end time point of the fifth output period T5'_OUT and the end time point of the sixth input period (T6_IN) (S18), and adds the difference of detection 0 to the sixth input period (T6_IN), to set a sixth output period T6_OUT (S20). In this instance, since there is no difference between the end time point of the fifth output period T5'_OUT and the end time point of the sixth input period (T6_IN), the backlight driver 30 sets a sixth output period T6_OUT the same with the sixth input period (T6_IN) (S16), and generates and outputs the output vertical synchronizing signal VSYNC_OUT having the sixth output period T6_OUT set thus (S10).

Then, as a seventh input period T7_IN of the input vertical synchronizing signal VSYNC_IN is the same with the sixth output period T6_OUT of the output vertical synchronizing signal VSYNC_OUT (S8: YES), the backlight driver 30 outputs the output vertical synchronizing signal VSYNC_OUT of a seventh output period T7_OUT (Not shown) which is the same with the seventh input period T7_IN.

FIG. 6 illustrates a case of steps for synchronizing input and output vertical synchronizing signals VSYNC_IN and VSYNC_OUT, if the frequency of the input vertical synchronizing signal VSYNC_IN decreases, i.e., the input period increases.

Referring to FIG. 6, since a second input period T2_IN of the input vertical synchronizing signal VSYNC_IN is the same with a prior first output period T1_OUT of the output vertical synchronizing signal VSYNC_OUT (S8: Yes), the output vertical synchronizing signal VSYNC_OUT having a second output period T2_OUT the same with the second input period T2_IN is output (S10).

Since it is a time point before a third input period T3_IN of the input vertical synchronizing signal VSYNC_IN is calculated, though the second output period T2_OUT of the output vertical synchronizing signal VSYNC_OUT ends, the backlight driver 30 outputs the second output period T2_OUT of the output vertical synchronizing signal VSYNC_OUT, repeatedly.

If the second output period T2_OUT ends (S12: YES) before the third input period T3_IN is calculated (Ends) while the third input period T3_IN of the input vertical synchronizing signal VSYNC_IN is not the same with a prior second output period T2_OUT of the output vertical synchronizing signal VSYNC_OUT (S8: NO) due to a reduced period (Increased frequency) of the input vertical synchronizing signal VSYNC_IN, the backlight driver 30 detects a difference A between the end time point of the second output period T2_OUT and the end time point of a third input period T3_IN (S14). And, the backlight driver 30 adds the difference A detected thus to the third input period T3-IN, to set a third output period T3'_OUT (S16), and generates and outputs the output vertical synchronizing signal VSYNC_OUT having the third output period T3'_OUT set thus (S10).

In the meantime, if calculation of the fifth input period T5_IN is also finished after the fourth input period T4_IN of the input vertical synchronizing signal VSYNC_IN ends during the output vertical synchronizing signal VSYNC_OUT of the third output period T3'_OUT is output, the fourth input period T4_IN and a difference between the fourth input period T4_IN and the third output period T3'_OUT are disregarded.

If the third output period T3'_OUT does not end before a fifth input period T5_IN is calculated (Ends) (S12: NO) while the fifth input period (T5_IN) of the input vertical synchronizing signal VSYNC_IN is not the same with the prior third output period T3'_OUT of the output vertical synchronizing signal VSYNC_OUT (S8: NO), the backlight driver 30 detects a difference C between the end time point of the third output period T3'_OUT to end and the end time point of the fifth input period (T5_IN) (S18). Then, the backlight driver 30 adds the difference C detected thus to the fifth input period (T5_IN), to set a fifth output period T5'_OUT (S20), and generates and outputs the output vertical synchronizing signal VSYNC_OUT having the fifth output period T5'_OUT set thus (S10).

If the fifth output period T5'_OUT does not end (S12: NO) before the sixth input period T6_IN is calculated (Ends) while the sixth input period T6_IN of the input vertical synchronizing signal VSYNC_IN is not the same with a prior fifth output period T5'_OUT of the output vertical synchronizing signal VSYNC_OUT (S8: NO), the backlight driver 30 detects a difference 0 between the end time point of the fifth output period T5'_OUT and the end time point of a sixth input period T6_IN (S18) and adds the difference 0 detected thus to the sixth input period T6-IN, to set a sixth output period T6_OUT (S16). In this instance, since there is no difference between the end time point of the fifth output period T5'_OUT and the end time point of the sixth input period (T6_IN), the backlight driver 30 sets a sixth output period T6_OUT the same with the sixth input period (T6_IN) (S16), and generates and outputs the output vertical synchronizing signal VSYNC_OUT having the sixth output period T6_OUT set thus (S10).

Then, as a seventh input period T7_IN of the input vertical synchronizing signal VSYNC_IN is the same with the sixth output period T6_OUT of the output vertical synchronizing signal VSYNC_OUT (S8: YES), the backlight driver 30 outputs the output vertical synchronizing signal VSYNC_OUT of a seventh output period T7_OUT (Not shown) which is the same with the seventh input period T7_IN.

Eventually, from FIGS. 4 to 6, it may be known that the input and output vertical synchronizing signals VSYNC_IN and VSYNC_OUT may be synchronized within a few frames (Periods) after change of the frequency of the input vertical synchronizing signal VSYNC_IN, as well as stable generation and outputting of the inner clock PCLK fixed with reference to a preset output period is possible even in the steps of synchronizing.

In the meantime, even though the present invention has been described only taking a method for synchronizing input and output synchronizing signals of the backlight driver as an example, the method for synchronizing input and output synchronizing signals is applicable, not only to the backlight driver, but also other devices which use the vertical synchronizing signal, and, not only to a method for synchronizing input and output vertical synchronizing signals, but also to a method for synchronizing other input and output synchronizing signals.

As has been described, the present invention has the following advantages.

The method and circuit for synchronizing input and output synchronizing signals, the backlight driver in a liquid crystal display device using the same, and the method for driving the backlight driver of the present invention adjust the input period detected according to a change of the input period of the synchronizing signal to use the input period adjusted thus as the output period, enabling to synchronize the input and output vertical synchronizing signals within a few frames even if the input period changes suddenly, and, since prediction of the output period is possible before generation of the output vertical synchronizing signal in advance, stable output period setting is possible in every step even in steps of synchronizing of the input and output vertical synchronizing signals.

Eventually, since the backlight driver in a liquid crystal display device using the same, and the method for driving the backlight driver of the present invention generate a fixed inner clock with reference to the stable output period to make stable generation of the PWM signal having a desired duty ratio to make stable driving of the backlight unit, the backlight driver in a liquid crystal display device using the same, and the method for driving the backlight driver of the present invention can prevent flicker from taking place.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for synchronizing input and output synchronizing signals, comprising the steps of:

detecting an Nth (N is a positive integer) input period of the input synchronizing signal;

determining whether the Nth input period detected is the same with a prior (N−1)th output period of the output synchronizing signal or not;

detecting a difference between an end time point of the (N−1)th output period and an end time point of the Nth input period, if the Nth input period detected in the determining step is not the same with the (N−1)th output period;

subjecting the difference detected in the detecting step to operation with the Nth input period, and setting a value obtained by the operation as an Nth output period; and generating and outputting the output synchronizing signal having the Nth output period set in the subjecting step.

2. The method according to claim 1, further comprising the steps of:

determining whether the Nth input period detected is within a preset reference range or not, after the step of detecting an Nth input period of the input synchronizing signal;

if it is determined that the Nth input period is outside of the reference range in above step, generating and outputting the output synchronizing signal having the (N−1)th output period; and if it is determined that the Nth input period is within the reference range in above step, proceeding to a step of determining whether the Nth input period is the same with the (N−1)th output period or not.

3. The method according to claim 1, further comprising the step of:

if the Nth input period is the same with the (N−1)th output period, proceeding to a step of outputting the Nth horizontal synchronizing signal after setting the Nth input period as an Nth output period.

4. The method according to claim 1, wherein the step of subjecting the difference detected in above step to operation with the Nth input period, and setting a value of the operation as an Nth output period includes the steps of;

if the Nth input period is increased longer than the (N−1)th output period, setting a value obtained by adding the difference detected in above step to the Nth input period as the Nth output period; and if the Nth input period is decreased shorter than the (N−1) the output period, setting a value obtained by subtracting the difference detected in above step from the Nth input period as the Nth output period.

5. The method according to claim 1, wherein the step of detecting a difference between an end time point of the (N−1) th output period and an end time point of the Nth input period includes the step of determining whether the (N−1)th output period ends before the Nth input period ends or not, if the Nth input period is not the same with the (N−1)th output period, and the step of subjecting the difference detected in above step to operation with the Nth input period, and setting a value obtained by the operation as an Nth output period includes the steps of;

setting a value obtained by adding the difference detected in above step thus to the Nth input period as the Nth output period, if the (N−1)th output period ends before the Nth input period ends, and setting a value obtained by subtracting the difference detected in above step thus from the Nth input period as the Nth output period, if the (N−1)th output period ends before the Nth input period ends.

6. The method according to claim 5, further comprising the step of repeating outputting of an output vertical synchronizing signal having the (N−1)th output period, if the Nth input period does not end, even though the (N−1)th output period ends.

7. The method according to claim 5, further comprising the step of disregarding the Nth input period, if the Nth input period ends and an (N+1)th input period also ends during the output synchronizing signal having the (N−1)th output period is output.

8. The method according to claim 1, wherein the Nth input period and the Nth output period of the synchronizing signal has a time difference of at least one period between the Nth input period and the Nth output period.

9. A method for driving a backlight driver comprising the steps of:

synchronizing an output vertical synchronizing signal to a change of an input period of an input vertical synchronizing signal;

generating an inner clock with reference to the output period set; and generating a pulse width modulation signal having a desired duty ratio by using the inner clock, to drive a backlight unit, wherein the synchronizing input and output synchronizing signals compries:

detecting an Nth (N is a positive integer) input period of the input synchronizing signal;

determining whether the Nth input period detected thus is the same with a prior (N−1)th output period of the output synchronizing signal or not;

detecting a difference between an end time point of the (N−1)th output period and an end time point of the Nth input period, if the Nth input period detected in above step is not the same with the (N−1)th output period;

subjecting the difference detected in above step to operation with the Nth input period, and setting a value obtained by the operation as an Nth output period; and generating and outputting the output synchronizing signal having the Nth output period set in the above subjecting step.

10. The method according to claim 9, further comprising the steps of:

determining whether the Nth input period detected thus is within a preset reference range or not, after the step of detecting an Nth input period of the input synchronizing signal;

if it is determined that the Nth input period is outside of the reference range in above step, generating and outputting the output synchronizing signal having the (N−1)th output period; and if it is determined that the Nth input period is within the reference range in above step, proceeding to a step of determining whether the Nth input period is the same with the (N−1)th output period or not.

11. The method according to claim 9, further comprising the step of:

if the Nth input period is the same with the (N−1)th output period, proceeding to a step of outputting the Nth horizontal synchronizing signal after setting the Nth input period as an Nth output period.

12. The method according to claim 9, wherein the step of subjecting the difference detected in above step to operation with the Nth input period, and setting a value of the operation as an Nth output period includes the steps of;

if the Nth input period is increased longer than the (N−1)th output period, setting a value obtained by adding the difference detected in above step to the Nth input period as the Nth output period; and if the Nth input period is decreased shorter than the (N−1)th output period, setting a value obtained by subtracting the difference detected in above step from the Nth input period as the Nth output period.

13. The method according to claim 9, wherein the step of detecting a difference between an end time point of the (N−1)th output period and an end time point of the Nth input period includes the step of determining whether the (N−1)th output period ends before the Nth input period ends or not, if the Nth input period is not the same with the (N−1)th output period, and the step of subjecting the difference detected in above step to operation with the Nth input period, and setting a value obtained by the operation as an Nth output period includes the steps of;

setting a value obtained by adding the difference detected in above step thus to the Nth input period as the Nth output period, if the (N−1)th output period ends before the Nth input period ends, and setting a value obtained by subtracting the difference detected in above step thus from the Nth input period as the Nth output period, if the (N−1)th output period ends before the Nth input period ends.

14. The method according to claim 13, further comprising the step of repeating outputting of an output vertical synchronizing signal having the (N−1)th output period, if the Nth input period does not end, even though the (N−1)th output period ends.

15. The method according to claim 13, further comprising the step of disregarding the Nth input period, if the Nth input period ends and an (N+1)th input period also ends during the output synchronizing signal having the (N−1)th output period is output.

16. The method according to claim 9, wherein the Nth input period and the Nth output period of the synchronizing signal has a time difference of at least one period between the Nth input period and the Nth output period.

17. A circuit for synchronizing input and output synchronizing signals comprising:

a synchronizing signal input unit that detects an Nth (N is a positive integer) input period of the input synchronizing signal;

a microcontroller unit that determines whether the Nth input period from the synchronizing signal input unit is the same with a prior (N−1)th output period of the output synchronizing signal or not, detectes a difference between an end time point of the (N−1)th output period and an end time point of the Nth input period, if the Nth input period detected in above step is not the same with the (N−1)th output period, subjecting the difference to operation with the Nth input period, and setting a value obtained by the operation as an Nth output period; and a synchronizing signal output unit that generates and outputs the output synchronizing signal having the Nth output period set by the microcontroller unit.

18. The circuit according to claim 17, wherein the microcontroller unit determines whether the Nth input period detected thus is within a preset reference range or not, and, if it is determined that the Nth input period is outside of the reference range, sets the (N−1)th output period as the Nth output period, and, if it is determined that the Nth input period is within the reference range, determines whether the Nth input period is the same with the (N−1)th output period or not.

19. The circuit according to claim 17, wherein the microcontroller unit sets the Nth input period as an Nth output period, if the Nth input period is the same with the (N−1)th output period.

20. The circuit according to claim 17, wherein the microcontroller unit sets a value obtained by adding the difference detected in above step to the Nth input period as the Nth output period, if the Nth input period is increased longer than the (N−1)th output period, and sets a value obtained by subtracting the difference detected in above step from the Nth input period as the Nth output period, if the Nth input period is decreased shorter than the (N−1)th output period.

21. The circuit according to claim 17, wherein the microcontroller unit further determines whether the (N−1)th output period ends before the Nth input period ends or not, if the Nth input period is not the same with the (N−1)th output period, sets a value obtained by adding the difference to the Nth input period as the Nth output period, if the (N−1)th output period ends before the Nth input period ends, and sets a value obtained by subtracting the difference from the Nth input period as the Nth output period, if the (N−1)th output period ends before the Nth input period ends.

22. The circuit according to claim 21, wherein the microcontroller unit makes to repeat to forward an output vertical synchronizing signal having the (N−1)th output period, if the Nth input period does not end even though the (N−1)th output period ends.

23. The circuit according to claim 21, wherein the microcontroller unit disregards the Nth input period, if the Nth input period ends and an (N+1)th input period also ends during the output synchronizing signal having the (N−1)th output period is output.

24. The circuit according to claim 17, wherein the microcontroller unit makes the Nth input period and the Nth output period of the synchronizing signal to have a time difference of at least one period between the Nth input period and the Nth output period.

25. A backlight driver in a liquid crystal display device, comprising:

a synchronizing circuit that synchronizes an output vertical synchronizing signal to a change of an input period of an input vertical synchronizing signal;

a clock generator that generates an inner clock with reference to the output period set by the circuit; and a pulse width modulation signal generator that generates a pulse width modulation signal having a desired duty ratio by using the inner clock, to drive a backlight unit, wherein the synchronizing circuit comprises:

a synchronizing signal input unit that detects an Nth (N is a positive integer) input period of the input synchronizing signal;

a microcontroller unit that determines whether the Nth input period from the synchronizing signal input unit is the same with a prior (N−1)th output period of the output synchronizing signal or not, detects a difference between an end time point of the (N−1)th output period and an end time point of the Nth input period, if the Nth input period detected in above step is not the same with the (N−1)th output period, subjects the difference to operation with the Nth input period, and setting a value obtained by the operation as an Nth output period; and a synchronizing signal output unit that generates and outputs the output synchronizing signal having the Nth output period set by the microcontroller unit.

26. The backlight driver according to claim 25, wherein the microcontroller unit determines whether the Nth input period detected thus is within a preset reference range or not, and, if it is determined that the Nth input period is outside of the reference range, sets the (N−1)th output period as the Nth output period, and, if it is determined that the Nth input period is within the reference range, determines whether the Nth input period is the same with the (N−1)th output period or not.

27. The backlight driver according to claim 25, wherein the microcontroller unit sets the Nth input period as an Nth output period, if the Nth input period is the same with the (N−1)th output period.

28. The backlight driver according to claim 25, wherein the microcontroller unit sets a value obtained by adding the difference detected in above step to the Nth input period as the Nth output period, if the Nth input period is increased longer than the (N−1)th output period, and sets a value obtained by subtracting the difference detected in above step from the Nth input period as the Nth output period, if the Nth input period is decreased shorter than the (N−1)th output period.

29. The backlight driver according to claim 25, wherein the microcontroller unit further determines whether the (N−1)th output period ends before the Nth input period ends or not, if the Nth input period is not the same with the (N−1)th output period, sets a value obtained by adding the difference to the Nth input period as the Nth output period, if the (N−1)th output period ends before the Nth input period ends, and sets a value obtained by subtracting the difference from the Nth input period as the Nth output period, if the (N−1)th output period ends before the Nth input period ends.

30. The backlight driver according to claim 29, wherein the microcontroller unit makes to repeat to forward an output vertical synchronizing signal having the (N−1)th output period, if the Nth input period does not end even though the (N−1)th output period ends.

31. The backlight driver according to claim 29, wherein the microcontroller unit disregards the Nth input period, if the Nth input period ends and an (N+1)th input period also ends during the output synchronizing signal having the (N−1)th output period is output.

32. The backlight driver according to claim 25, wherein the microcontroller unit makes the Nth input period and the Nth output period of the synchronizing signal to have a time difference of at least one period between the Nth input period and the Nth output period.

* * * * *